US006289192B1

(12) United States Patent
Nukada et al.

(10) Patent No.: US 6,289,192 B1
(45) Date of Patent: Sep. 11, 2001

(54) COLOR IMAGE FORMING APPARATUS

(75) Inventors: Hideki Nukada; Masashi Hiroki, both of Yokohama; Kenichi Takahara, Tokyo, all of (JP)

(73) Assignee: Kabushuki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/534,626

(22) Filed: Mar. 27, 2000

(30) Foreign Application Priority Data

Mar. 30, 1999 (JP) ..... 11-089339

(51) Int. Cl.[7] ..... G03G 15/10

(52) U.S. Cl. ..... 399/250; 399/92; 399/237; 399/359

(58) Field of Search ..... 399/249, 250, 399/251, 237, 91, 92, 348, 358, 359; 430/117, 125

(56) References Cited

U.S. PATENT DOCUMENTS 5,463,453 * 10/1995 Kurotori et al. ..... 399/249
5,592,269 * 1/1997 Younes et al. ..... 399/237
5,841,456 * 11/1998 Takei et al. ..... 399/249 X
5,884,128 * 3/1999 Park ..... 399/250
5,946,528 * 8/1999 Cho ..... 399/237 X
6,047,151 * 4/2000 Carvalho et al. ..... 399/250
6,078,776 * 6/2000 Okamoto et al. ..... 399/308

FOREIGN PATENT DOCUMENTS 9-329968 12/1997 (JP) .

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An color image forming apparatus is disclosed which forms an electrostatic latent image on a photosensitive drum with the use of a charger and laser beam for light exposure, develops the electrostatic latent image into a visible image by a developing unit with the use of a liquid developer with a coloring material of very fine particles mixed in an insulating solvent and transfers the visible image to a recording sheet with the use of a transfer roller with a heater reincorporated therein. In this color image forming apparatus, a partition wall is provided for covering the transfer roller as a solvent vapor producing source to prevent the diffusion of a solvent vapor, and a cooling panel constituting at least part of a surface of the partition wall opposite to the transfer roller is cooled to a temperature lower than an ambient temperature within the partition wall, whereby it is possible to suppress the diffusion of the solvent in the liquid developer to a minimal possible level and efficiently collect the solvent for recovery and to achieve a stable developing characteristic.

19 Claims, 6 Drawing Sheets

COLOR IMAGE FORMING APPARATUS

CROSS-REFERENCE TO RELATED APPLICATIONS

This application is based upon and claims the benefit of priority from the prior Japanese Patent Application No. 11-089339, filed Mar. 30, 1999, the entire contents of which are incorporated herein by reference.

BACKGROUND OF THE INVENTION

The present invention relates to an electrophotographic type color image forming apparatus and, more particularly, to a color image forming apparatus using a liquid developer with a fine particle coloring material mixed into an insulating solvent.

Of the electrophotographic type image forming apparatus, a so-called wet type image forming apparatus using a liquid developer has advantages not realized by a dry type image forming apparatus and, in recent years, their merits have been reevaluated. The wet type image forming apparatus has major advantages over the dry type image forming apparatus in terms of (a) being capable of realizing a high image quality with the use of a very fine particle toner of the order of a submicron size, (b) capable of obtaining an adequate image density with less amount of toner and, in addition to being thus economical, also capable of realizing a texture just equal to that of a printing (for example, an offset printing), (c) capable of fixing the toner to a recording sheet at a relatively low temperature and thus achieving an energy saving, etc.

In the conventional wet type electrophotographic technique using a liquid toner as a developer, however, there arise essential problems and, for this reason, the dry type electrophotographic technique has been unrivaled in its market. As its one problem, it has to use a liquid developer containing a high resistant or insulating petroleum solvent as a carrier solvent so as to develop an electrostatic latent image. In an image forming process, this solvent is quickly consumed and it is, therefore, necessary to effect a frequent exchange of the solvent tanks, so that the maintenance becomes poor.

For this reason a squeegee roller is provided so as to, after a developing step, scrape any excessive solvent from a photosensitive drum surface. It is thus necessary to collect any not-requisite solvent, even if being small in its amount, from the drum surface for a recycling purpose. Since, at the same time, there arise an evolution of an odor resulting from the evaporation of the solvent as well as an allergy action of it on a human body, etc. It is, therefore, desirable to collect the solvent into the apparatus to a practically possible extent and prevent it from being evaporated to an outside.

In the image forming apparatus using a liquid developer, an indirect transfer method has usually been employed according to which, in order to retain a better image, an image on a photosensitive drum is once transferred to a transfer roller, such as a transfer drum, instead of effecting an image transfer in a way to set a recording sheet in direct contact with the photosensitive drum, and an image on the transfer roller is transferred to a recording sheet by contacting the image with the recording sheet under an application of a pressure to the recording sheet. In this case, the image on the photosensitive drum is placed under an electric field or a pressure such that the image can be readily moved onto the transfer drum.

In such a process, the solvent is evaporated on a heated transfer drum and, when the evaporated solvent (solvent vapor) is exhausted to an outside of the apparatus, the odor and allergy problems may occur as set out above. It is, therefore, necessary to prevent the diffusion of such solvent vapor produced on the transfer drum.

In the image forming apparatus using a liquid developer, it is required that, while maintaining the conditions of forming a good quality image, consideration be paid to ensuring an effective consumption of the developer and environmental health. It is, therefore, necessary to prevent any leakage of the solvent vapor from the apparatus and to collect the solvent vapor, through liquefaction, for a recycling purpose. The greatest task of the wet type image forming apparatus using the liquid developer is as to how the developer solvent should be recovered for recycling and how the leakage of the solvent to an outside be suppressed to a minimal extent.

Against these requests a method may be considered by which the solvent vapor is reduced by passing air in the apparatus, for example, through a filter. In this case, the solvent vapor collection method is by introducing a circulation air in the apparatus into a filter using an adsorbent such as an activated carbon and, after adsorbing the solvent vapor onto the adsorbent, returning it again into the apparatus or exhausting it to an outside, etc. Since, in this method, no entire consideration is paid to the recycling of the solvent vapor, much more solvent is consumed and, since the life of the filter is usually limited, it is determined depending upon an amount of adsorbing solvent. Therefore, the greater the amount of solvent vapor, the quicker the filter's performance begins to be lowered. This necessitates the frequent exchanges of filters. Further it may be considered that a scattered solvent vapor in the apparatus is deposited here and there and gives a serious damage to the apparatus.

BRIEF SUMMARY OF THE INVENTION

Accordingly, it is an object of the present invention to provide an image forming apparatus which can suppress the diffusion of solvent in a liquid developer to a minimum extent, effectively collect the solvent and obtain a stable developing characteristic.

According to one aspect of the present invention, there is provided an image forming apparatus, comprising: a latent image carrier; an image exposure unit configured to form a latent image on the latent image carrier; a development unit configured to develop the latent image on the latent image carrier into a visible image by a liquid developer having a coloring material mixed in solvent; a transfer body configured to transfer the visible image from the latent image carrier onto a recording medium; and a first partition wall covering part of the latent image carrier or part of the transfer body, and having an inner surface facing the part of the latent image carrier or the part of the transfer body.

The apparatus may further comprise a solvent collection unit configured to collect part of the solvent liquefying on the inner surface of the first partition wall. In this case, the solvent collection unit may comprise a roller supported by the first partition wall and a blade which scrapes off part of the solvent from the roller. The solvent collection unit may comprise a roller on which part of the solvent liquefies and a blade which scrapes off the part of the solvent from the roller, and wherein the first partition wall covers the roller.

The apparatus may further comprise a cooling unit configured to cool the first partition wall. In this case, the cooling unit may comprise a fan. The apparatus may further comprise a solvent collection unit configured to collect part of the solvent liquefying on the inner surface of the first partition wall. In this case, the solvent collection unit may comprise a wiper which wipes off part of the solvent from the inner surface of the first partition wall. The solvent collection unit may comprise a belt running in a predetermined direction on which part of the solvent liquefies, and a blade which scrapes off the part of the solvent from the belt. The solvent collection unit may comprise a tank which mixes a coloring material into the solvent collected by the solvent collection unit to produce a liquid developer, and a circulating path which supplies the liquid developer produced in the tank to the development unit.

The first partition wall may cover the part of the transfer body and the transfer body has a heater.

The apparatus may further comprise: a cleaner configured to clean the image carrier by removing residual coloring material from the latent image carrier; and a second partition wall covering part of the cleaner and having an inner wall surface facing the cleaner, wherein part of the solvent liquefies on the inner surface of the second partition wall. In this case, the apparatus may further comprise a cooling unit configured to cool the second partition wall. The apparatus may further comprise a solvent collection unit configured to collect the part of the solvent liquefying on the second partition wall. The cleaner may have a heater.

According to another aspect of the present invention, there is provided an image forming apparatus, comprising: an image carrier; a transfer body which transfers a visible image which is formed on the image carrier onto a recording medium; and first partitioning means for covering part of the image carrier or part of the transfer body.

The apparatus may further comprise means for cooling the first partitioning means.

The first partitioning means may cover the part of the transfer body and the transfer body has a heater.

The apparatus may further comprise: a cleaner which cleans the image carrier by removing residual coloring material from the image carrier; and second partitioning means for covering part of the cleaner, wherein solvent liquefies on the inner surface of the second partitioning means.

According to still another aspect of the present invention, there is provided an image forming method, comprising steps of: developing a latent image formed on a latent image carrier to provide a visible image; and transferring the visible image from the latent image carrier onto a recording medium by a transfer body, part of the latent image carrier or part of the transfer body being covered with a first partition wall.

The method may further comprise a cooling step of cooling the first partition wall. In this case, the method further comprise a collecting step of collecting solvent liquefying on the inner surface of the first partition wall. The method may further comprise a recycling step of recycling the collected solvent for the developing.

The method may further comprise a cleaning step of cleaning the image carrier by removing residual coloring material from the latent image carrier using a cleaner, part of the cleaner being covered with a second partition wall. In this case, the method may further comprise a cooling step of cooling the second partition wall. The method may further comprise a collecting step of collecting solvent liquefying on the second partition wall.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiments of the present invention will be explained below with reference to the accompanying drawings.

First Embodiment

Figure 1:
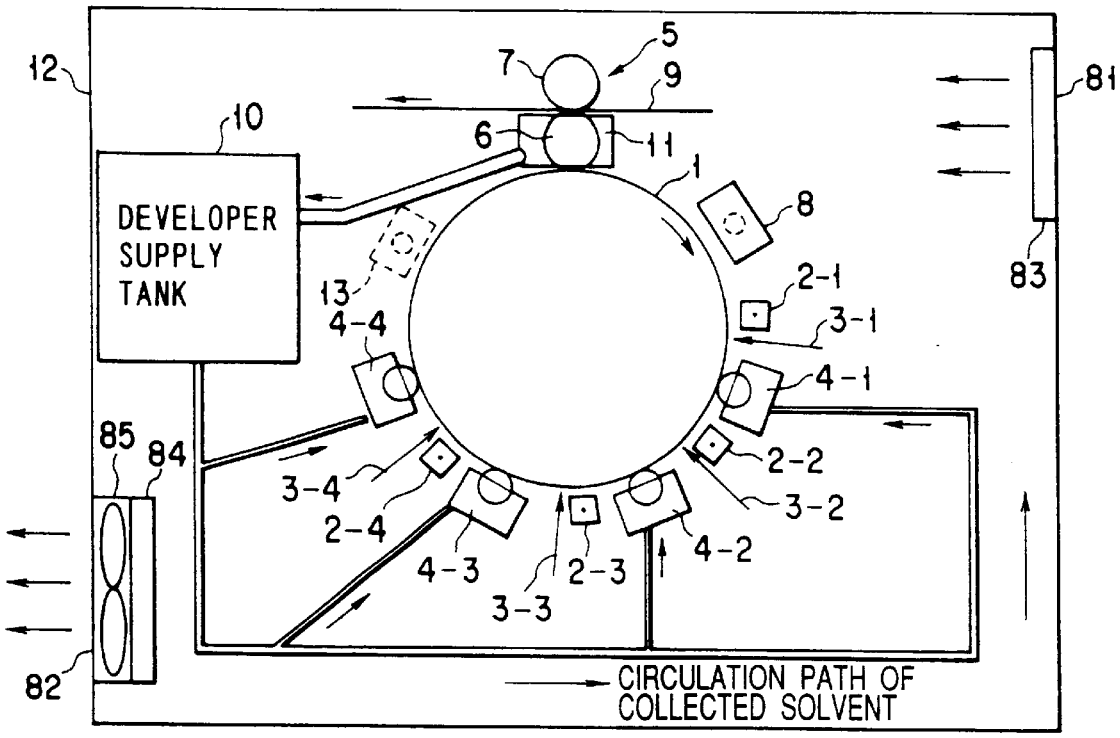
FIG. 1 is a view showing an arrangement of a color image forming apparatus according to a first embodiment of the present invention.

FIG. 1 shows an arrangement of a color image forming apparatus according to a first embodiment of the present invention.

A photosensitive drum 1 serving as a latent image carrier includes a cylindrical conductive substrate and an organic- or amorphous silicon-type photosensitive layer formed on the cylindrical conductive substrate. The drum is rotated by a motor (not shown) in a direction as indicated by an arrow in FIG. 1 and, while being rotated, moved sequentially past charge/expose/develop stations located at four places in a spaced-apart relation in a rotational movement direction (hereinafter referred to as a sub-scanning direction) as will be set out below.

The photosensitive drum 1, after having its photosensitive layer surface uniformly charged by a first charger 2-1 composed of a corona charger or scorotron charger, is exposed in a forward side of the sub-scanning direction of the charger 2-1 with a laser beam 3-1 for first exposure which is modulated in accordance with first color image information (for example, yellow image data) and, by doing so, has a first electrostatic latent image formed on its photosensitive layer surface. Thereafter, the electrostatic latent image formed with the laser beam 3-1 for first exposure is developed by a first developing unit 4-1 holding a first color (for example, yellow) liquid developer therein and, with the liquid developer or toner (first color) deposited on the electrostatic latent image, a first color visible image is formed.

Although the thus formed first color visible image may be transferred by a first transfer unit 5 to a recording sheet as a recording medium, here it is followed by the next expose/develop step. That is, the photosensitive drum 1 is then uniformly charged by a second charger 2—2 and, after forming a second electrostatic latent image on the same drum position as that of the first electrostatic latent image by a laser beam 3-2 for second exposure which is modulated by a second color image information (for example, magenta image data), the latent image is developed by a second developing unit 4-2 holding a second color (for example, magenta) liquid developer different from that held in the first developing unit to provide a second color visible, image. Thus, after this developing step, the first and second color visible images are formed on the drum surface in a registered fashion.

In a similar way, the uniform charging of the drum surface by a third charger 2-3, formation of a third electrostatic latent image by a laser beam 3—3 for third exposure which is modulated by third color image information (for example, cyan image data) and formation of a third color (for example, cyan) visible image are sequentially performed. And, further, the uniform charging of the drum surface by a fourth charger 2-4, formation of a fourth electrostatic latent image by a laser beam 3-4 for fourth exposure which is modulated by fourth color image information (for example, black image data) and formation of a fourth color (for example, black) visible image are performed in a sequential way.

In this way, for example, the yellow (Y), magenta (M), cyan (C) and black (K) visible images are registered on the photosensitive drum surface to provide a full color image. The color image on the drum surface is transferred by a transfer unit 5 on the recording sheet 9. Although, at this time, the full color image on the drum surface may be transferred directly to the recording sheet 9, here, it is transferred to the recording sheet 9 through a transfer roller 6 serving as an intermediate transfer medium.

The transfer of an image from the drum 1 to the transfer roller 6 and transfer of it to the recording sheet 9 can be done either under an electric field or under pressure (and heat). Many liquid developers are of such a type as to fix an image to the recording sheet generally at room temperature. But it may be possible to heat a pressure application roller 7, etc., as shown, for example, in FIG. 1 and fix an image to the recording sheet under the application of heat.

After the image transfer has been effected by the transfer roller 6, a residual developer on the drum surface is removed by a cleaner 8.

A color image forming process as set out above is disclosed, for example, in U.S. Pat. No. 5,570,173, etc.

In the case where a color image on the photosensitive drum 1 is transferred to the transfer roller 6 under an electric field, a smoother transfer is performed as set out above if a very small solvent remains on the photosensitive drum 1. The solvent on the drum 1 is also deposited on the transfer roller 6 and evaporated from there. If this solvent vapor is left as it is, it may be scattered here and there in the apparatus. According to this embodiment, a solvent collection unit is provided as will be set out below.

That is, with a transfer point of the transfer roller 6 as a center position as shown in FIG. 1, a partition wall 11 is provided to cover the transfer roller 6 so as to prevent the diffusion of the solvent vapor. Within the partition wall 11, the solvent vapor is liquefied as will be set out below and this liquid solvent is scraped off and collected into a developer supply tank 10 for recovery. The liquid solvent thus collected into the developer supply tank is mixed with a coloring material and recirculated through the developing units 4-1 to 4—4 for recycling.

The color image forming apparatus as a whole is held within a housing 12 and prevents the solvent vapor from leaking out of the apparatus. The housing 12 has an air inlet section 81 for circulating a flow of air therethrough and an air outlet section 82 for discharging the air toward an outside. A remaining housing area other than these openable sections provides a hermetically sealable structure for sealing off the air. At the air inlet section 81 and air outlet section 82 a filter 83 and filter 84 are respectively provided to allow the solvent vapor to be absorbed therein. It is to be noted that these filters can be replaced. And a fan 85 is provided at the air outlet section 82 to allow the air to be discharged toward an outside.

Figure 2:
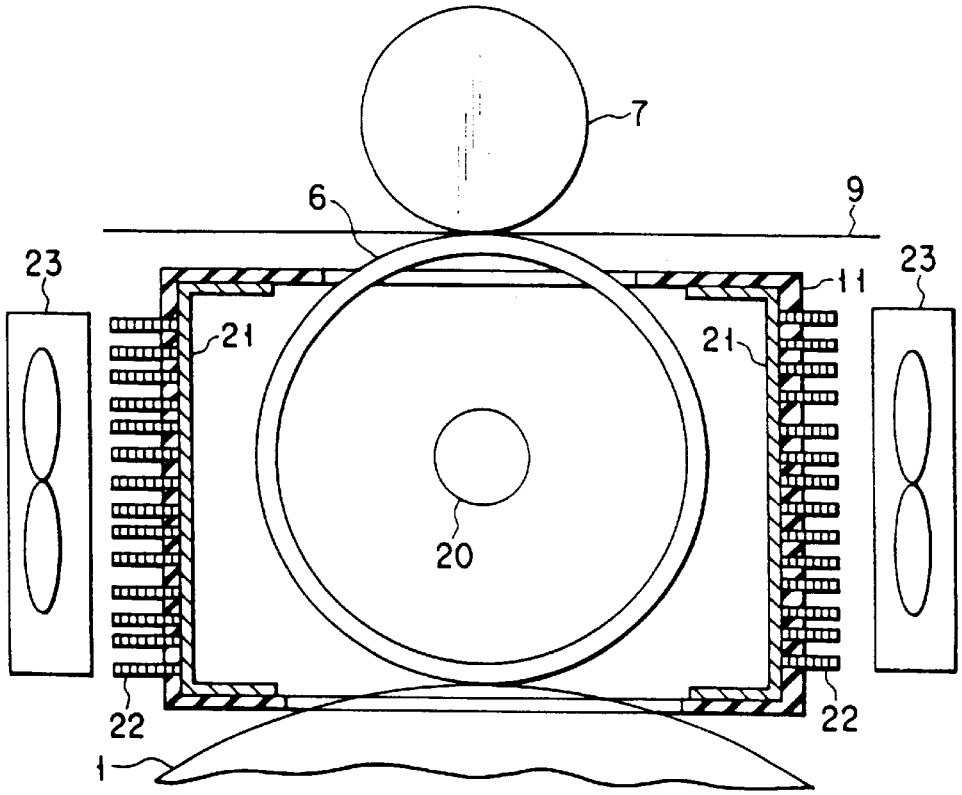
FIG. 2 is a view showing an arrangement of a solvent collection unit in the first embodiment.

FIG. 2 is an enlarged cross-sectional view showing a major section of this embodiment including the partition wall 11, that is, a section where a color image on the photosensitive drum 1 is transferred by the transfer roller 6 to a recording sheet 9. The partition wall 11 is so configured as to be made substantially hermetic therein. That is, although a vary small clearance is provided between the partition wall 11 on one hand and the transfer roller 6 and photosensitive drum 1 on the other hand, it is very small compared with the whole volume, so that an amount of air entering and leaving it is very small and negligible, that is, it is set in a substantially hermetic state.

Within the transfer roller 6 a heater 20 is incorporated therein to allow an image transfer to be readily performed at the image transfer point, noting that the transfer roller 6 is warmed by the heater 20 from its inside. When, therefore, a color image on the photosensitive drum 1 is contacted with the transfer roller 6, a surrounding very small solvent is warmed into a vapor. And a toner constituting a color image becomes partially fused and separated from the surface of the photosensitive drum 1 and transferred in intimate contact state onto the transfer roller 6 and then transferred from the transfer roller 6 onto the recording sheet 9.

On the transfer roller 6 all the residual solvent which is not evaporated at an initial contact receives adequate heat and is evaporated, so that there occurs almost no deposition of the solvent onto the recording sheet 9. In a process of transferring an image from the photosensitive drum 1 directly onto the recording sheet 9 without using the transfer roller 6 it may sometimes be effective to transfer an image to the recording sheet after solvent has been fully let off the surface of the photosensitive drum 1.

There is a risk that, without depending upon whether or not the transfer roller 6 is used, a solvent film left in the process as set out above will become a vapor of a relatively high density and, while being diffused from the drum surface, be liquefied on the inner surface of the apparatus. When an attempt is made to all remove such solvent vapor with a filter using an activated carbon, etc., then it very quickly exceeds its allowable absorption amount and needs to be replaced with a new filter frequently. Even if the solvent vapor diffused within the apparatus is to be collected, it is very hard to collect the solvent effectively because, once being diffused, its density becomes too low.

According to this embodiment, on the other hand, the transfer roller 6 of a solvent vapor producing source is covered with the partition wall 11 to prevent a free flow of air there, and the solvent vapor is less likely to be diffused into any other zone.

Now the arrangement of this embodiment will be explained below in more detail with reference to FIG. 2. A cooling panel 21 is provided within the partition wall 11 at those areas opposite to the transfer roller 6 of the solvent vapor producing source, in particular, on both side surfaces of right and left areas (front and back sides of the photosensitive drum 1 as viewed in the rotational direction) nearest to the transfer roller 6 as shown in FIG. 2. The cooling panel 21 is made of a better heat conductive material and, in this case, cooling fins 22 are provided as a cooling unit such that they are abutted against the back surface of the cooling panel. According to this embodiment, in order to enhance a cooling effect, air is blown by fans 23 toward the cooling fins 22.

As set out above, the solvent on the surface of the transfer roller 6 is warmed by the heater 20 to produce solvent vapor and, at this time, an ambient temperature in the neighborhood of the solvent vapor exceeds an average ambient temperature in the apparatus. If, therefore, the cooling panel 21 maintains the average temperature within the apparatus, the solvent vapor hitting on the cooling panel 21 is cooled and the resultant solvent again liquefied on the cooling panel 21.

The cooling panel 21 is so arranged as to have the cooling fins 22 abutted thereagainst, and its surface is held at an ambient temperature around the fins 22. In other words, the cooling panel 21 is not lowered below the ambient temperature around the partition wall 11. For this reason, a water vapor is not liquefied on the cooling panel 21 and only solvent is liquefied on the cooling panel 21. If, therefore, the liquefied solvent are collected, a collected solvent can be readily reutilized directly as the developer solvent. It is effective to connect the cooling panel 21 to external fins with the use of an effective heat conductive means, such as a heat pipe, as a means for maintaining the cooling panel 21 at an external ambient temperature around the partition wall 11.

The solvent vapor thus liquefied on the cooling panel 21 becomes a solvent liquid film and the whole surface of the cooling surface 21 is covered with the solvent liquid film. This film acts as a heat insulating material between an outside and the cooling panel 21 and a fresh vapor is less likely to be liquefied. As a result, a newly produced solvent vapor fills the inside of the partition wall 11 without being liquefied and leaks toward an outside.

Figure 3B:
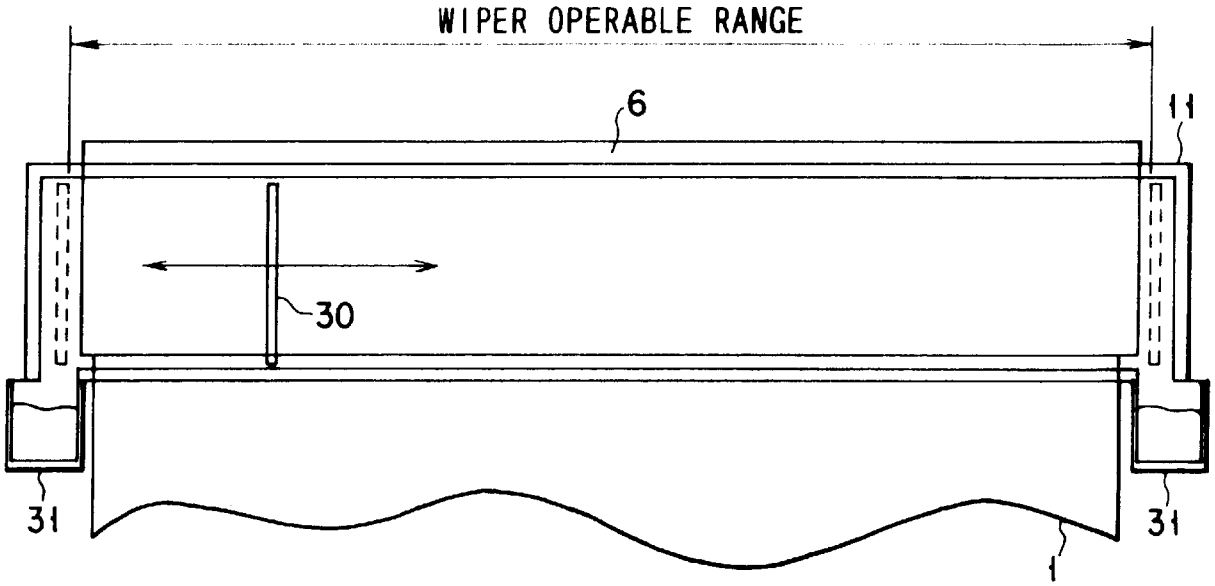
FIGS. 3A to 3C are views showing a structure of a wiping mechanism in the embodiment shown.
Figure 3A:
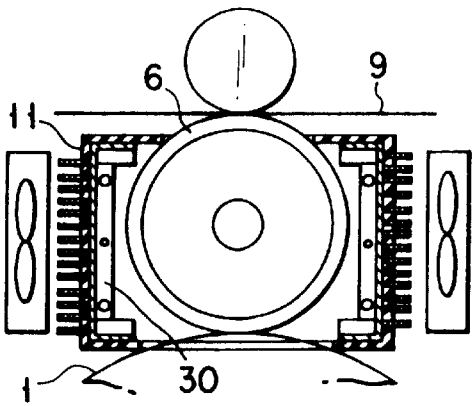

According to this embodiment, therefore, a wiper 30 is provided, as shown in FIGS. 3A and 3B, for periodically wiping off the surface of the cooling panel 21. The wiper 30 is constituted by a solvent-resistant elastic member, such as an oil-resistant urethane blade, and, by being linearly moved in reciprocatory motion by a drive mechanism, a film resulting from the drops of the solvent liquid on the cooling panel 21 can be wiped off in right/left directions (or a left or right direction) on the cooling panel 21.

Figure 3C:
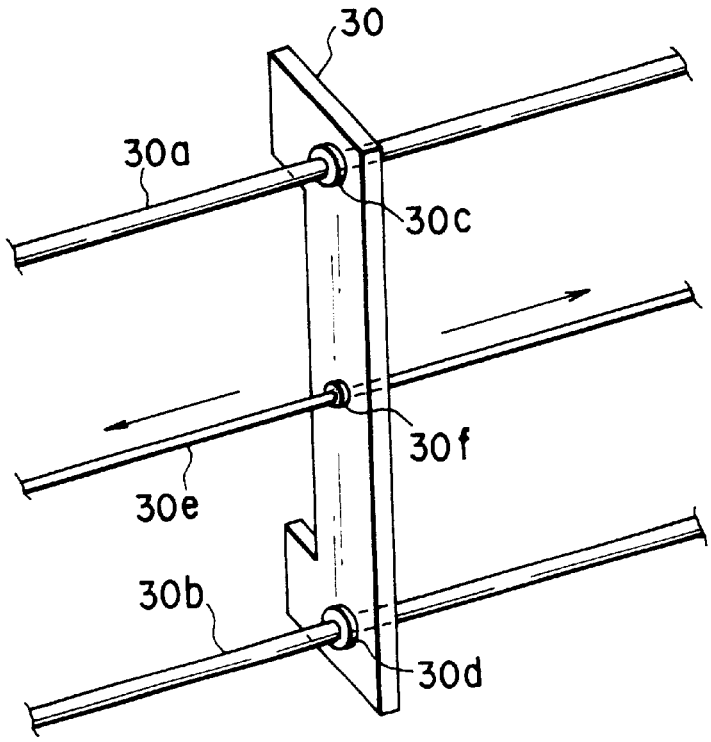

Stated in more detail, two rails 30*a*, 30*b* are initially prepared as shown in FIG. 3C and the wiper 30 is fitted on the rails 30*a* and rail 30*b*, respectively, through bearings 30*c* and 30*d*. A wire 30*e* is fitted on a fixed section 30*f* of the wiper 30. In this state, the wiper 30 can be repetitively pulled by a motor, etc., in an arrow direction (right/left directions) in FIG. 3C.

The thus wiped solvent liquid is collected into solvent liquid collection pockets 31 provided at those opposite ends of the partition wall 11 and recovered for recirculation in the image forming process.

Since the solvent thus collected into the solvent liquid collection pocket 31 contain no water as set out above, it is supplied to the developer supply tank 10 as shown in FIG. 1 where it is mixed with the coloring material. The mixed solvent liquid is recirculated as the developer into the developing units 4-1 to 4—4 for recycling.

In the color image forming apparatus thus obtained, the partition wall 11 is provided for preventing the diffusion of the solvent vapor from the developer and the solvent vapor is liquefied on the cooling panel 21 for collection. By doing so, it is possible to realize a solvent vapor collection mechanism of a very good recovery efficiency.

By efficiently collecting solvent vapor of high density and liquefying it, a residual solvent vapor density in the partition wall 11 is not raised to over a predetermined level and it is relatively easy to remove it by a secondary treatment. Even if use is made of, for example, a method by which it is removed with a filter, a residual solvent amount is smaller than in the conventional method and it is possible to largely extend the life of the filter. If the solvent vapor is very low in density, it is possible to diffuse the vapor as it is within the apparatus.

Although, in the above-mentioned explanation, the transfer roller 6 is regarded as the solvent vapor producing source, if the cleaner 8 is provided with a heater incorporated therein, solvent vapor is produced there and it is desirable to provide a solvent collection unit similarly including a partition wall. Even if a solvent collection unit 13 is provided such that a heater is incorporated in a position as indicated by a broken line in FIG. 1, it is desirable to provide a solvent collection unit including a partition wall at that place.

Second Embodiment

Figure 4:
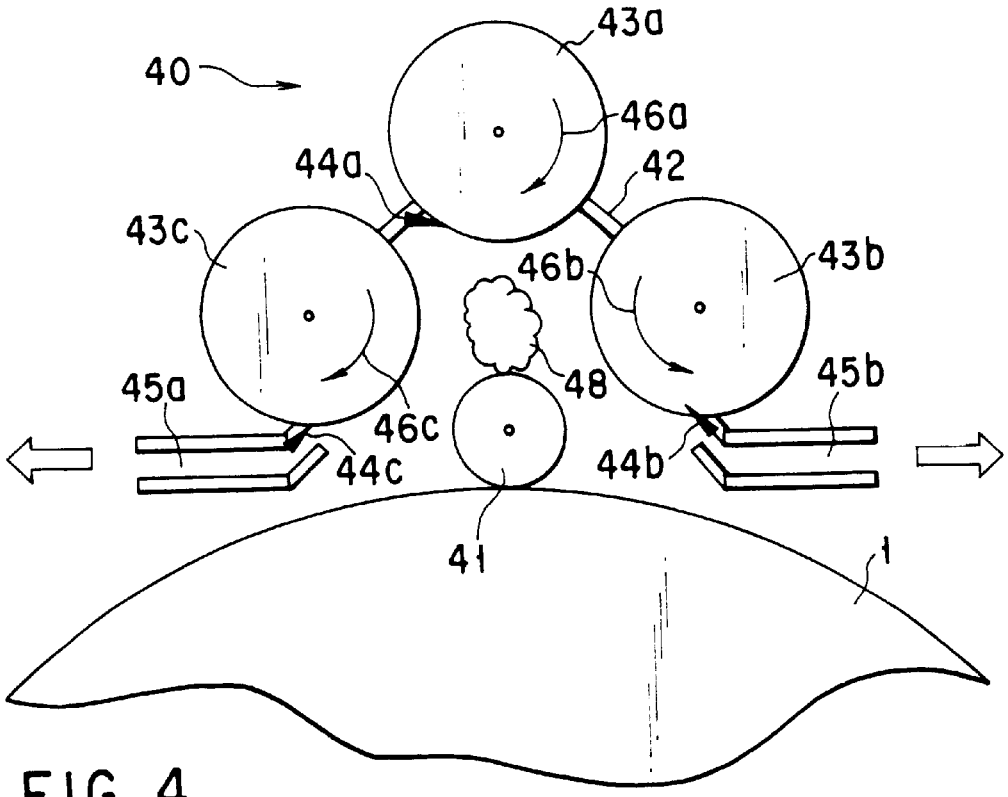
FIG. 4 is a view showing an arrangement of a solvent collection unit in a second embodiment of the present invention.

FIG. 4 is a partly enlarged view showing a solvent collection unit 13 having a partition wall section of a color image forming apparatus according to a second embodiment of the present invention. In this embodiment, a liquid developer is evaporated on a photosensitive drum 1 to deposit solvent vapor onto a roller corresponding to an inner wall of the partition wall section and, by doing so, it is possible to effectively collect the solvent vapor for recovery. The basic structure of the color image forming apparatus as a whole is similar to that of the first embodiment and any further explanation of it is, therefore, omitted.

The partition wall section 40 of this embodiment includes a partition wall 42 including a heating roller 41 partly arranged on the photosensitive drum 1 and adapted to evaporate a liquid developer's solvent, under heat, deposited on the drum 1, squeegee rollers 43*a*, 43*b* and 43*c* rotatably supported on the partition wall 42 and so arranged as to allow no vapor to leak through the partition wall 42, blade sections 44*a*, 44*b* and 44*c* scraping off the developer's solvent deposited on the inner surface of the partition wall section 40, and collection ports 45*a* and 45*b* collecting the scraped solvent for recovery.

The squeegee rollers 43*a*, 43*b* and 43*c* are rotationally driven, by a drive section not shown, in those directions of arrows 46*a*, 46*b* and 46*c* as shown in FIG. 4. Further, the partition wall 42 and squeegee rollers 43*a*, 43*b* and 43*c* are maintained by a not-shown temperature adjusting unit (for example, a fan) to an ordinary temperature or average temperature in the apparatus.

In the partition wall section 40 thus configured, an evaporated liquid developer's solvent 48 is allowed to be positively deposited, within the partition wall section 40, on the surfaces of the rotationally driven squeegee rollers 43*a*, 43*b* and 43*c* and the deposited solvent can be collected, by the blade sections 44*a*, 44*b* and 44*c*, from the collection ports 45*a* and 45*b*.

According to this embodiment, a fresh roller surface not wetted with the liquid developer's solvent is always provided, by rotationally driving the squeegee rollers 43*a*, 43*b* and 43*c*, the deposition of the solvent onto these rollers 43*a*, 43*b* and 43*c* is enhanced, thus allowing the solvent to be efficiently collected. The rollers 43*a*, 43*b* and 43*c*, being rotated toward the directions of the collection ports 45*a*, 45*b*, allow the solvent which is positively deposited thereon to be transported for recovery. Further, the partition wall 42 and collection ports 45a and 45*b* are inclined and the solvent is collected in a natural way.

The heating roller 41 is not restricted to a configuration shown in FIG. 4 and it may include a heat supply means, such as an infrared heater, which is provided relative to an outer peripheral portion of the photosensitive drum 1 to allow an evaporation of the liquid developer's solvent deposited on the drum 1.

Although, in FIG. 4, the partition wall 42 and squeegee rollers 43*a*, 43*b* and 43*c* have to be sealed, if the blade sections 44*a*, 44*b* and 44*c* and passageway of the liquid developer's solvent are secured, it may be possible to provide a partition wall with which the squeegee rollers 43*a*, 43*b* and 43*c* are wholly covered. In this case, it is not necessary to effect a seal between the partition wall 42 and the squeegee rollers 43*a*, 43*b* and 43*c* and a simpler partition wall section is constructed.

The developer collection mechanism of this embodiment can efficiently collect the liquid developer's solvent, in a simpler structure, deposited on the inner surface of the partition wall, can use an ordinary rotation drive component part without the necessity of providing any particular rotation control device and can provide a structure of high reliability.

Third Embodiment

Figure 5:
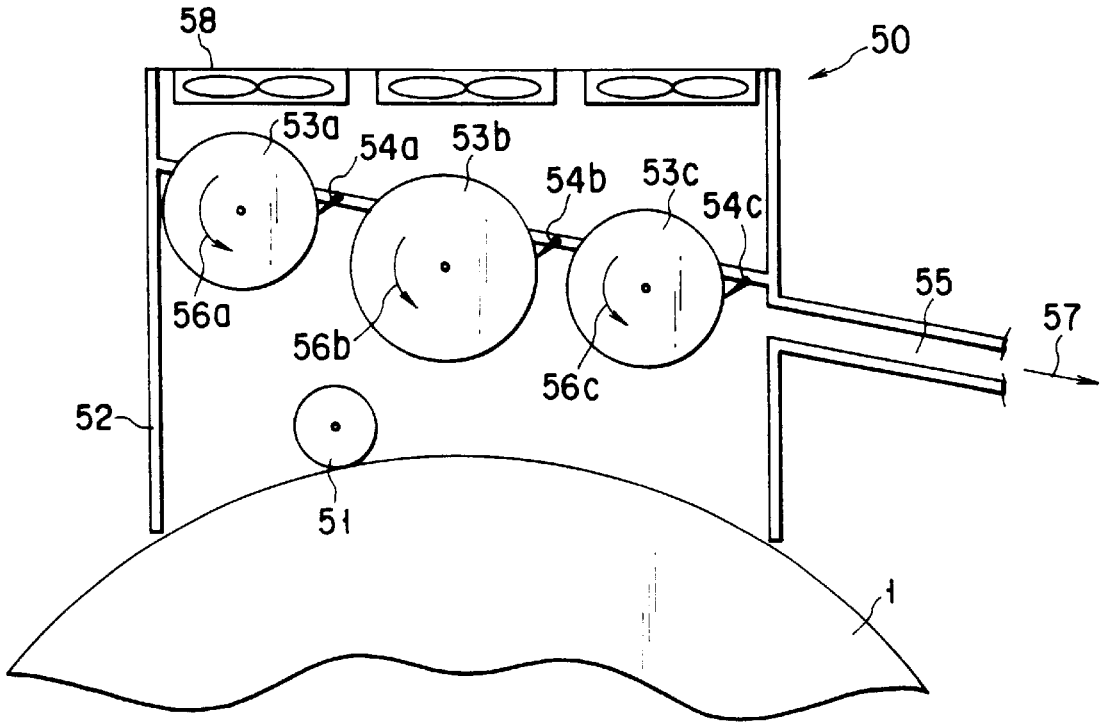
FIG. 5 is a view showing a structure of a solvent collection unit in a third embodiment of the present invention.

FIG. 5 is a partly enlarged view showing a solvent collection unit 13 according to a third embodiment of the present invention. This embodiment is of such a type as to, like the second embodiment, allow a liquid developer's solvent which is evaporated on a photosensitive drum 1 to be deposited onto rollers corresponding to an inner surface of a partition wall section and to efficiently collect the drops of the liquid developer's solvent for recovery. The basic structure of the color image forming apparatus is similar to that of the first embodiment and any further explanation is, therefore, omitted.

The partition wall section 50 of this embodiment includes a partition wall 52 surrounding a heating roller 51 arranged relative to a portion of a photosensitive drum 1 and adapted to evaporate the liquid developer's solvent, by heat, deposited on the drum 1, squeegee rollers 53*a*, 53*b* and 53*c* rotatably supported on the partition wall 52 with their rotation centers set within the partition wall 52 and so arranged as to prevent any leakage of solvent vapor into and out of the partition wall 52, blade sections 54*a*, 54*b* and 54*c* adapted to, within the partition wall section 50, scrape off the liquid developer's solvent deposited on the surfaces of the rollers 53*a*, 53*b* and 53*c*, and a collection port 55 collecting the thus scraped solvent for recovery.

The rollers 53*a*, 53*b* and 53*c* are rotationally driven by a drive section (not shown) in these directions as indicated by arrows 56*a*, 56*b* and 56*c* in FIG. 5. The partition wall 52 and rollers 53*a*, 53*b* and 53*c* are maintained to an ordinary temperature or an average temperature in the apparatus by a temperature adjusting device 58 (for example, a fan unit).

In the partition wall section 50 thus arranged, the solvent vapor is allowed to be positively deposited on the inner surface of the partition wall section 50 due to the rollers 53*a*, 53*b* and 53*c* arranged with their rotation centers set within the partition wall 52 and the deposited solvent can be collected by the blade sections 54*a*, 54*b* and 54*c* in an arrow 57 direction from the collection port 55 as shown in FIG. 5.

In the developer solvent collection unit of this embodiment, a fresh surface not wetted with the liquid developer's solvent is always provided by the rotations of the squeegee rollers 53*a*, 53*b* and 53*c* and the deposition of the liquid solvent on these rollers 53*a*, 53*b* and 53*c* is enhanced to allow the developer's solvent to be efficiently collected and, in addition, a greater solvent deposition area can also be obtained due to the rollers 53*a*, 53*b* and 53*c* arranged with their rotation centers set within the partition wall 52. It is, therefore, possible to more efficiently collect the solvent for recycling than in the second embodiment.

The heating roller 51 is not restricted to the configuration shown in FIG. 5 and may include a heat supply means, such as an infrared heater, provided relative to an outer peripheral portion of the photosensitive drum 1 and capable of evaporating the liquid developer's solvent deposited on the drum 1.

In this embodiment, a greater solvent deposition area can be obtained in a simpler structure by arranging the squeegee rollers with their rotation centers set within the partition wall, thus making it possible to efficiently collect the liquid developer's solvent deposited on the inner surface of the partition wall. The arrangement of this embodiment allows the use of an ordinary rotation drive component part and obviates the necessity to use any special rotation control device. It is, therefore, possible to provide a solvent collection unit of high reliability.

Fourth Embodiment

Figure 6:
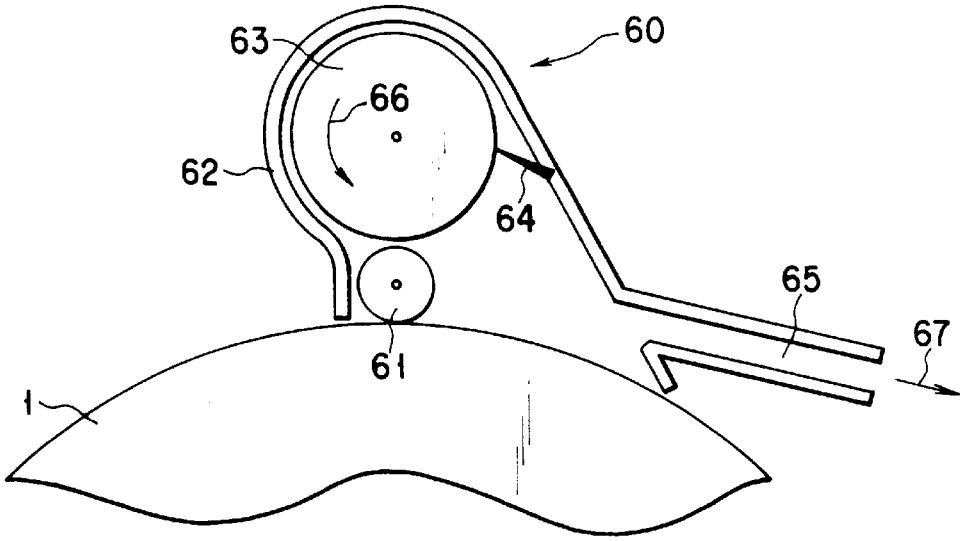
FIG. 6 is a view showing a structure of a solvent collection unit in a fourth embodiment of the present invention.

FIG. 6 is a partly enlarged view showing a solvent collection unit 13 according to a fourth embodiment of the present invention. As in the case of the second and third embodiments, this embodiment enables a liquid developer's solvent which is evaporated on a photosensitive drum 1 to be deposited on a roller corresponding to an inner wall of a partition wall section and enables the solvent which is liquefied to be efficiently collected for recovery.

A partition wall section 60 of this embodiment includes a partition wall 62 surrounding a heating roller 61 arranged relative to a portion of the drum 1 and adapted to evaporate a liquid developer's solvent by heat which is deposited on the drum 1, a squeegee roller 63 rotatably supported on the partition wall 62 and arranged within the partition wall 62, a blade section 64 provided within the partition wall section 60 and adapted to scrape off a liquid developer's solvent deposited on the roller 63, and a collection port 65 collecting the scraped solvent for recovery.

The roller 63 is rotationally driven by a drive section (not shown) in a direction of an arrow 66 in FIG. 6. Further, the partition wall 62 and roller 63 are maintained to an ordinary temperature or an average temperature ($+\alpha$) in the apparatus by a temperature adjusting device (for example, a fan) not shown.

In the partition wall section 60 thus arranged, solvent vapor of the liquid developer is positively deposited on the rotationally driven roller 63 and the deposited solvent can be collected by the blade section 64 in an arrow 67 direction (FIG. 6) from the collection port 65.

According to this embodiment, it is possible that, by the rotational drive of the roller 63, a fresh roller surface provided by the scraping action of the blade is always exposed with the solvent vapor and, due to this enhanced deposition of the liquid developer's solvent, the solvent is efficiently collected for recovery. Since the roller 63 is surrounded with the partition wall 62, it is not necessary to provide a sealing section relative to the outside of the partition wall 62. This can provide a highly reliable developer solvent collection unit having no slidable section relative to the partition wall section 60. Since, in particular, the roller 63 and heating roller 61 are completely surrounded on a left side with the partition wall 62, the developer solvent can be positively sent out toward the collection port 65 side without causing the liquid developer's solution to remain within the apparatus.

Since, in this embodiment, the roller 63 can be arranged in the neighborhood of the heating roller 61, it is possible that, just after the evaporation of the developer solvent, a solvent vapor molecule impinges onto the surface of the squeegee roller 63 maintained to a predetermined temperature to allow the vapor to be effectively liquefied. A partition wall section 60 of this embodiment includes a partition wall 62 surrounding a heating roller 61 arranged relative to a portion of the drum I and adapted to evaporate a liquid developer's solvent by heat which is deposited on the drum 1, a squeegee roller 63 rotatably supported on the partition wall 62 and arranged within the partition wall 62, a blade section 64 provided within the partition wall section 60 and adapted to scrape off a liquid developer's solvent deposited on the roller 63, and a collection port 65 collecting the scraped solvent for recovery.

Fifth Embodiment

Figure 7:
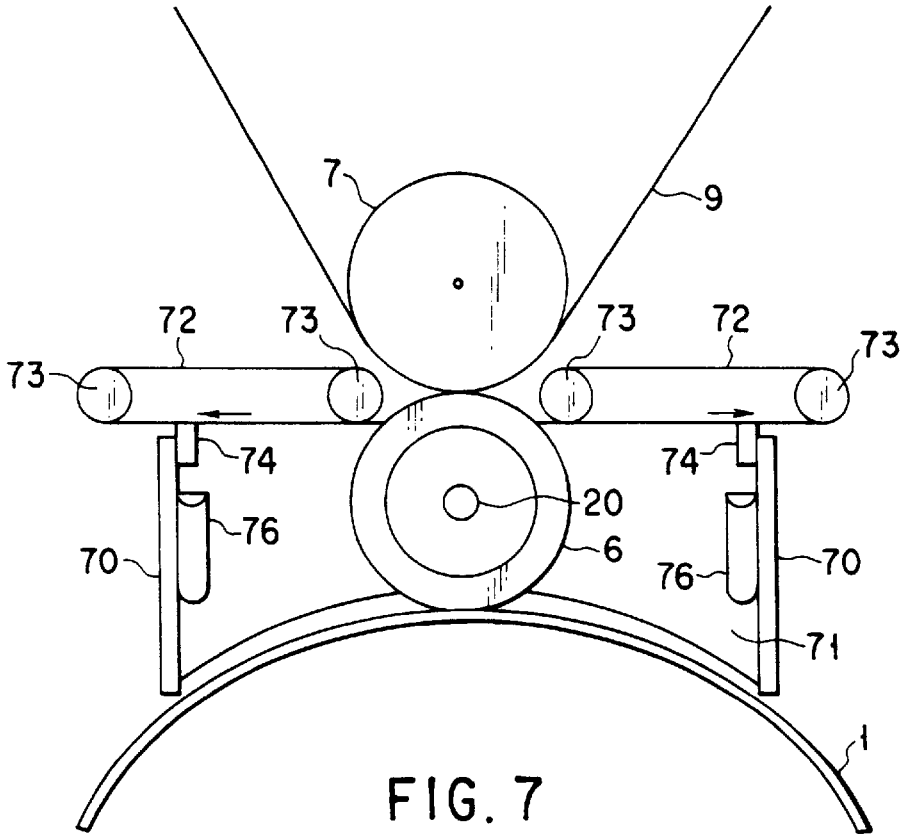
FIG. 7 is a view showing a structure of a solvent collection unit in a fifth embodiment of the present invention.

FIG. 7 shows an arrangement of a major section according to a fifth embodiment of the present invention.

In this embodiment, a partition wall covering a transfer roller 6 as a solvent vapor producing source includes case sections 70 covering a forward/backward side and case sections 71 covering a right/left side of the roller 6 relative to the moving direction of a photosensitive drum 1 belts 72 so arranged as to cover an upper side (a side opposite to the drum 1) in the view of the case sections 70, 71. Belts 72 are of an endless type and mounted between two shafts 73. The lower runs of these belts are moved away from the transfer roller 6 by a drive device not shown. Further, an elastic blade 74 is provided on the case section 70 in a manner to be contacted with the lower run of the belt 72. And a drain pipe 76 is provided beneath the blade 74 as will be set out below.

Figure 8:
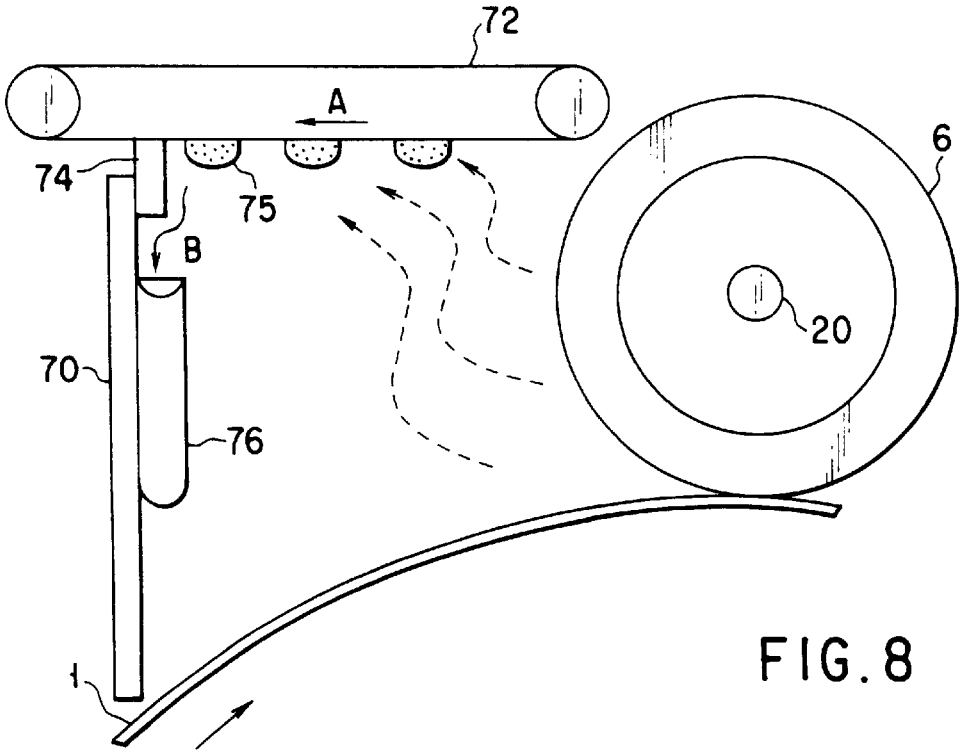
FIG. 8 is a view showing a solvent drop wiping mechanism in the embodiment above.

With reference to FIG. 8 an explanation will be made below about the operation of collecting solvent vapor by the movement of the belts 72.

Although only the upstream side of the transfer roller 6 in the moving direction of the photosensitive drum 1 is shown in FIG. 8, the same situation arises even on the downstream side. Solvent, together with a toner image, carried in a state deposited on the surface of the drum 1 is heated by the transfer roller 6 and evaporated. The solvent vapor is diffused upwardly and a greater part of it is deposited on the lower run surface of the belt 72 situated above the partition wall and, at that place, condensed into liquid drops 75.

Here, the belt 72 is run in a direction of an arrow A in FIG. 8 and the liquid drops are scraped off by the blade 74 and flowed downwardly in a direction of an arrow B in FIG. 8. The belt 72, being run past the blade 74, is brought back to a state not deposited with the solvent liquid drops and, being moved in that state, can cover the solvent vapor producing section in that state normally not deposited with the solvent liquid. Therefore, the solvent vapor produced at a printing operation can be collected continuously and efficiently as set out above. By flowing air toward the belt 72 by a fan, not shown, or cooling the belt in contact with fins, the recovery efficiency of the solvent vapor is further improved.

Figure 9:
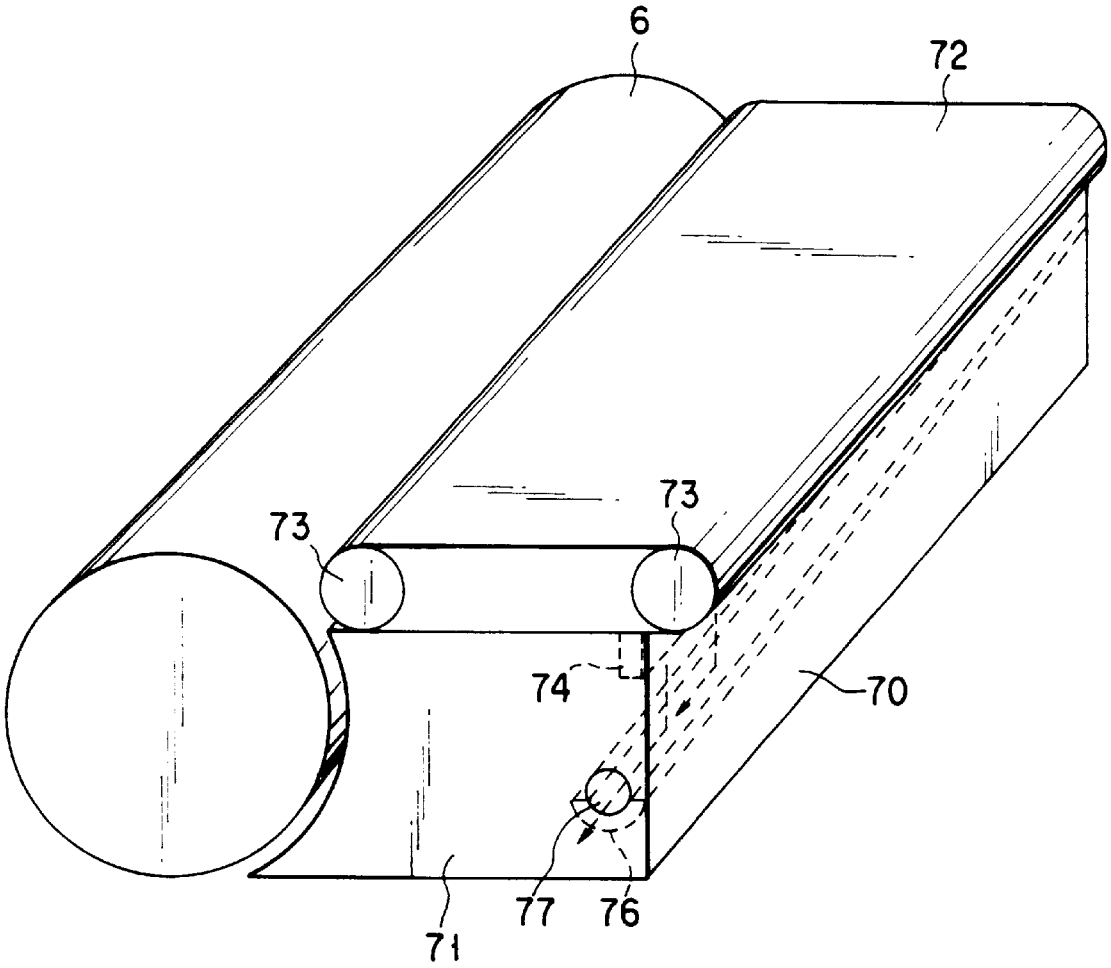
FIG. 9 is a view showing a solvent drop collection path in the embodiment above.

FIG. 9 is a view for explaining a collection path of the solvent liquid drops scraped by the blade 74 off the belt. As shown in FIG. 9, the drain pipe 76 is provided in an inclined fashion in the inner wall of the case section 70 covering the forward/backward side of the transfer roller 6 and, in the case section 71 covering the right-left side of the transfer roller 6, an opening 77 is provided at a place contacting with a lower end side of the drain pipe 76. Therefore, the solvent liquid drops scraped by the blade 74 flows down the drain pipe 76 and is returned back to a circulation path through the opening 77.

According to the present invention, as set out in detail above, the partition wall is provided to seal the solvent vapor of the developer and the solvent vapor is condensed into liquid drops for recovery. This collection mechanism can very effectively recover the solvent vapor produced in the process of the apparatus. It is, therefore, possible to remarkably reduce any adverse effects, such as the scattering of the solvent within the apparatus and leakage of a larger amount of solvent vapor out of the apparatus. It is thus possible to provide a wet type color image forming apparatus which can ensure a very efficient utilization of the solvent and an added safety.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus, comprising:

a latent image carrier;

an image exposure unit configured to form a latent image on the latent image carrier;

a development unit configured to develop the latent image on the latent image carrier into a visible image by a liquid developer having a coloring material mixed in solvent;

a transfer body configured to transfer the visible image from the latent image carrier onto a recording medium;

a first partition wall covering part of the latent image carrier or part of the transfer body, and having an inner surface facing the part of the latent image carrier or the part of the transfer body; and a solvent collection unit configured to collect part of the solvent liquefying on the inner surface of the first partition wall, the solvent collection unit comprising a wiper which wipes off part of the solvent from the inner surface of the first partition wall.

2. The apparatus according to claim 1, further comprising a cooling unit configured to cool the first partition wall.

3. The apparatus according to claim 2, wherein the cooling unit comprises a fan.

4. The apparatus according to claim 1, wherein the solvent collection unit comprises a belt running in a predetermined direction on which part of the solvent liquefies, and a blade which scrapes off the part of the solvent from the belt.

5. The apparatus according to claim 1, wherein the solvent collection unit comprises a tank which mixes a coloring material into the solvent collected by the solvent collection unit to produce a liquid developer, and a circulating path which supplies the liquid developer produced in the tank to the development unit.

6. The apparatus according to claim 1, wherein the first partition wall covers the part of the transfer body and the transfer body has a heater.

7. The apparatus according to claim 1, further comprising:

a cleaner configured to clean the latent image carrier by removing residual coloring material from the latent image carrier; and a second partition wall covering part of the cleaner and having an inner wall surface facing the cleaner, wherein part of the solvent liquefies on the inner surface of the second partition wall.

8. The apparatus according to claim 7, further comprising a cooling unit configured to cool the second partition wall.

9. The apparatus according to claim 7, further comprising a solvent collection unit configured to collect the part of the solvent liquefying on the second partition wall.

10. The apparatus according to claim 7, wherein the cleaner has a heater.

11. An image forming method, comprising steps of:

developing a latent image formed on a latent image carrier to provide a visible image;

transferring the visible image from the latent image carrier onto a recording medium by a transfer body, part of the latent image carrier or part of the transfer body being covered with a first partition wall;

cleaning the latent image carrier by removing residual coloring material from the latent image carrier using a cleaner, part of the cleaner being covered with a second partition wall; and cooling the second partition wall.

12. The method according to claim 11, further comprising a cooling step of cooling the first partition wall.

13. The method according to claim 12, further comprising a collecting step of collecting solvent liquefying on the inner surface of the first partition wall.

14. The method according to claim 13, further comprising a recycling step of recycling the collected solvent for the developing.

15. The method according to claim 11, further comprising a collecting step of collecting solvent liquefying on the second partition wall.

16. An image forming apparatus, comprising:

a latent image carrier;

an image exposure unit configured to form a latent image on the latent image carrier;

a development unit configured to develop that latent image on the latent image carrier into a visible image by a liquid developer having a coloring material mixed in solvent;

a transfer body configured to transfer the visible image from the latent image carrier onto a recording medium;

a partition wall covering part of the latent image carrier or part of the transfer body, and having an inner surface facing the part of the latent image carrier or the part of the transfer body; and a solvent collection unit configured to collect part of the solvent liquefying on the inner surface of the partition wall, the solvent collection unit comprising a roller supported by the partition wall and a blade which scrapes off part of the solvent from the roller.

17. The apparatus according to claim 16, wherein the partition wall covers the roller.

18. The apparatus according to claim 16, further comprising a cooling unit configured to cool the partition wall.

19. The apparatus according to claim 18, wherein the cooling unit comprises a fan.

* * * * *

UNITED STATES PATENT AND TRADEMARK OFFICE

CERTIFICATE OF CORRECTION

PATENT NO. : 6,289,192 B1
DATED : September 11, 2001
INVENTOR(S) : Nukada et al.

It is certified that error appears in the above-identified patent and that said Letters Patent is hereby corrected as shown below:

Title page,
Item [73], the Assignee's name should read:

-- [73] Assignee: Kabushiki Kaisha Toshiba, Kawasaki (JP) --

Signed and Sealed this

Twentieth Day of May, 2003

JAMES E. ROGAN
*Director of the United States Patent and Trademark Office*